US006637615B2

(12) United States Patent
Kawasumi et al.

(10) Patent No.: US 6,637,615 B2
(45) Date of Patent: Oct. 28, 2003

(54) THERMAL INSULATION BOX

(75) Inventors: Masaaki Kawasumi, Ohara-gun (JP); Kunihiko Ishitomi, Yatsuka-gun (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 0 days.

(21) Appl. No.: 09/990,701

(22) Filed: Nov. 9, 2001

(65) Prior Publication Data

US 2003/0089724 A1 May 15, 2003

(51) Int. Cl.[7] ..... B65D 81/38; F25D 23/00

(52) U.S. Cl. ..... 220/592.03; 220/592.09; 220/4.02

(58) Field of Search ..... 220/592.25, 592.02, 220/592.03, 592.09, 4.02, 592.1, 592.2

(56) References Cited

U.S. PATENT DOCUMENTS 2,537,314 A * 1/1951 Mortensen ..... 220/592.02 X
3,240,029 A * 3/1966 Wurtz ..... 220/592.09 X
4,360,105 A * 11/1982 Williams ..... 220/592.25 X
4,368,819 A * 1/1983 Durham ..... 220/592.25 X
4,903,858 A * 2/1990 Clark et al. ..... 220/592.02
4,917,256 A * 4/1990 Kruck et al. ..... 220/592.03 X

* cited by examiner

*Primary Examiner*—Joseph M. Moy
(74) *Attorney, Agent, or Firm*—Koda & Androlia

(57) ABSTRACT

A thermal insulation box has upper protrusions and front protrusions formed on the top face and on the front faces of an ice bin, respectively. A step is formed on the upper face of a front panel. The front panel, which has on the rear face holding recesses for admitting the front protrusions formed in the ice bin, is fitted to cover the front protrusions with the holding recesses. A top plate has a reinforcing rib formed integrally therewith circumferentially along the lower edge. With the top plate being attached to the casing body, the front part of the reinforcing rib is fitted to cover the step of the front panel, whereas the side parts of the reinforcing rib are fitted to cover the upper protrusions of the ice bin.

1 Claim, 15 Drawing Sheets

THERMAL INSULATION BOX

FIELD OF THE INVENTION

The present invention relates to a thermal insulation box, for example, for an automatic ice-making machine.

DESCRIPTION OF RELATED ART

As shown in FIG. 15, a thermal insulation box employed in an automatic ice-making machine has a casing body 12. The casing body 12 is formed by disposing a pair of side panels 11 on the external sides of a right side wall and a left side wall of an ice bin 10 to be spaced away from each other crosswise. The ice bin 10 has an upward opening and a forward opening. An ice-making unit (not shown) suspended from a mounting frame (not shown) provided horizontally in an upper part of the casing body 12 is designed to be located in an upper space in the ice bin 10. Each side panel 11 has at the front a U-shaped portion 11*a* having a U-shaped cross section in plan view and at the upper edge an upper inward bent portion 11*b* (bent toward the ice bin), so that the U-shaped portion 11*a* and the upper bent portion 11*b* of the side panel 11 are adapted to be positioned by fitting the former to the front face and by placing the latter on the top face of the associated side wall of the ice bin 10, respectively.

A front frame 13 is attached to the front of the casing body 12 at a predetermined position lower than the top thereof. The front frame 13 prevents inward deformation and the like of the right and left sidewalls 12*a* (each sidewall being composed of the side wall of the ice bin 10 and the side panel 11) in the casing body 12 and secures a forward opening 12*b* for the casing body 12. The front frame 13 is box-shaped and opens backward (toward the ice bin) as shown in FIG. 15, and a heat-insulating material 14 formed separately is designed to be inserted into the frame 13. The front frame 13 is fitted to the casing body 12 by abutting both lateral side faces of the frame 13 against the inner faces of the U-shaped portions 11*a* and, in this state, fixing the former to the latter by caulking, respectively, followed by insertion of the heat-insulating material into the frame 13. Here, the front frame 13 is made of a suitable metallic material so that it can function as a magnetic attracting face for a magnet attached to a door (not shown), which opens and closes freely the forward opening 12*b* of the casing body 12.

A front panel 15 is removably attached to the front of the casing body 12. The front panel 15 covers the portion of the forward opening 12*b* upper than the location of the front fame 13. This front panel 15 is box-shaped and opens backward (toward the ice bin), as shown in FIG. 15, and a heat-insulating material 16 formed separately is designed to be inserted into the front panel 15. The front panel 15 has on the rear side a pair of engaging holes 15*a* near the crosswise ends thereof. The engaging holes 15*a* are engaged with screw collars 17 located on the front ends of the sidewalls 12*a* of the casing body 12 (front faces of the U-shaped portions 11*a* of the side panels 11), respectively, to achieve positioning of the front panel 15 with respect to the casing body 12. The front panel 15 has a positioning piece 15*b* extended downward from the rear lower edge thereof. With the positioning piece 15*b* being abutted against the front face of the front frame 13, the positioning piece 15*b* is designed to be fixed to the front frame 13 through a screw 18. Here, the front panel 15 has an engaging portion 15*c* formed along the rear upper edge thereof, which is engageable with a counterpart engaging portion 19*b* of a top plate 19 (to be described later).

A top plate 19, which closes an upward opening 12*c* of the casing body 12, is box-shaped and opens downward (toward the ice bin), and a heat-insulating material 20 formed separately is adapted to be inserted into the top plate 19. The opening of the top plate 19 is designed to be slightly larger than the outside dimensions of the casing body 12. With the top plate 19 being placed on the top of the casing body 12, the top plate 19 is fixed at both lateral side faces to the right and left side panels 11 with screws 21, respectively. The top plate 19 has an engaging slot 19*a* defined in the rear part thereof, which can be engaged with a latch 22 fitted to the rear face of the casing body 12, and also has a counterpart engaging portion 19*b* formed at the front, which can be engaged with the engaging portion 15*c* of the front panel 15. More specifically, the top plate 19 is designed to be placed on the top of the casing body 12 and to be screwed thereto at both lateral side faces with the latch 22 being engaged with the engaging slot 19*a* of the top plate 19 and with the counterpart engaging portion 19*b* being engaged with the engaging portion 15*c* of the front panel 15.

The thermal insulation box described above involves a problem that the front panel 15 is merely brought into face contact at the rear face with the front faces of the sidewalls 12*a* of the casing body 12, so that gaps are likely to be formed therebetween, and there is a fear that contaminated water, oil, dust, insects, etc. enter the ice bin 10 through these gaps.

While the front panel 15 is positioned by engagement of the engaging holes 16*a* with the screw collars 17 attached to the casing body 12, the engaging holes 15*a* are designed to have a large inside diameter so as to facilitate engagement with the screw collars 17, taking the trouble for carrying out accurate positioning of the front panel 15 for fixing it by screwing to the front frame 13. Meanwhile, it can also be pointed out referring to the top plate 19 that it takes the trouble for achieving positioning thereof with respect to the casing body 12, since the top plate 19 is designed to have outside dimensions large enough to achieve engagement of the front part and rear part thereof with the engaging portion 15*c* of the front panel 15 and with the latch 22, respectively.

SUMMARY OF THE INVENTION

The present invention was accomplished in view of the problems inherent in the prior art described above and to solve them suitably, and is directed to providing a thermal insulation box, which is easy to attach and can be kept always hygienically.

In order to solve the problems described above and to attain the intended object suitably, the thermal insulation box according to the present invention is provided with a front panel attached to a front part of a casing body having a forward opening so as to cover the forward opening; the front panel being packed with a foamed heat-insulating material; characterized in that the casing has front protrusions formed on the front face of the casing body; and fitting recesses which are formed on the rear face of the front panel and which are to be fitted to cover the front protrusions of the casing body.

In order to solve the problems described above and to attain the intended object suitably, the thermal insulation box according to another aspect of the present invention is provided with a top plate disposed on top of a casing body having an upward opening so as to cover the upward opening; the top plate being packed with a foamed heat-insulating material; characterized in that the casing has upper protrusions formed on the top face of the casing body;

and fitting portions which are formed along the lower edge of the top plate and which are to be fitted to cover the upper protrusions of the casing body.

DETAILED DESCRIPTION OF PREFERRED EMBODIMENTS

Next, the thermal insulation box according the present invention will be described below by way of a preferred embodiment referring to the attached drawings. Here, the embodiment exemplifies a thermal insulation box for an automatic ice-making machine.

Overall Constitution

Figure 1:
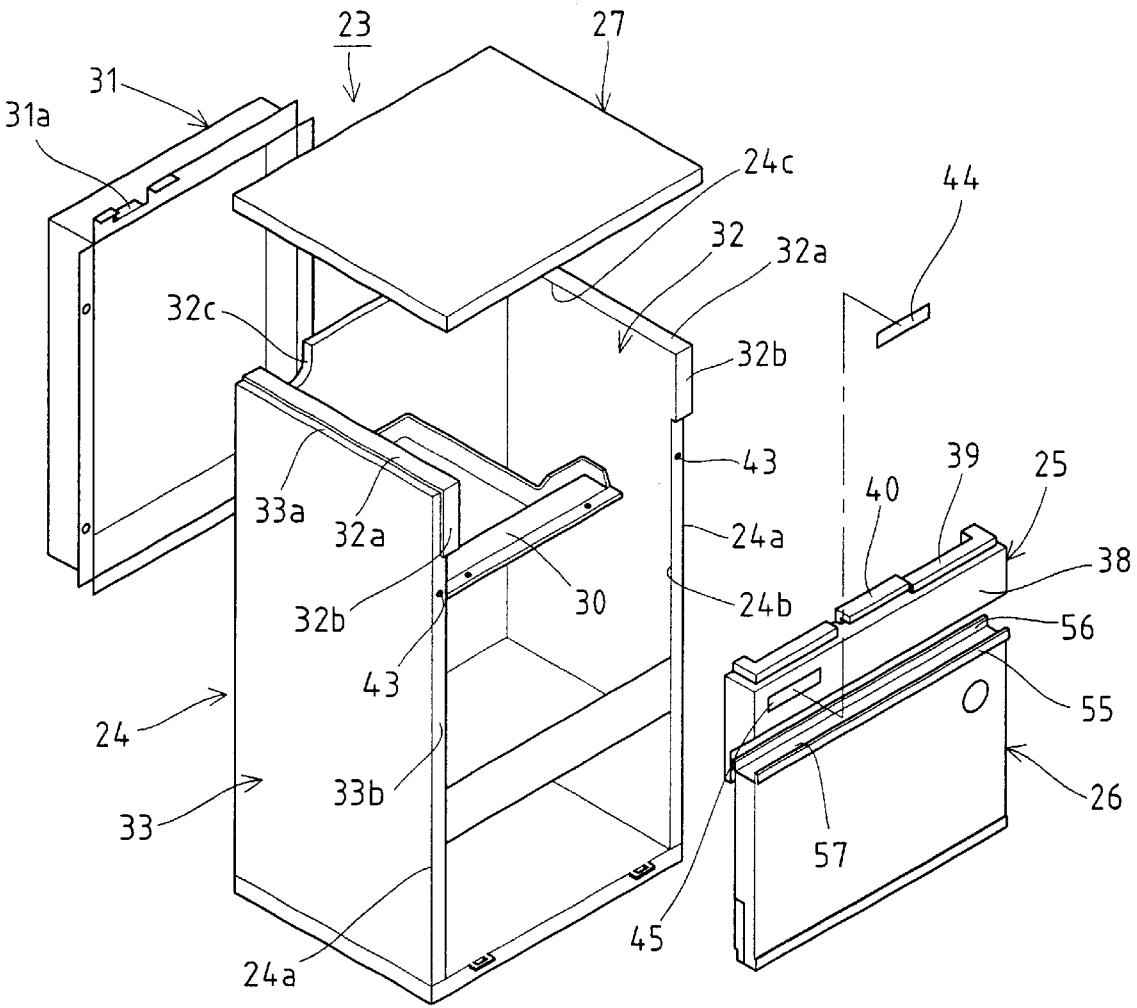
FIG. 1 is an exploded schematic perspective view showing relevant portions of the thermal insulation box according to a preferred embodiment of the present invention.
Figure 2:
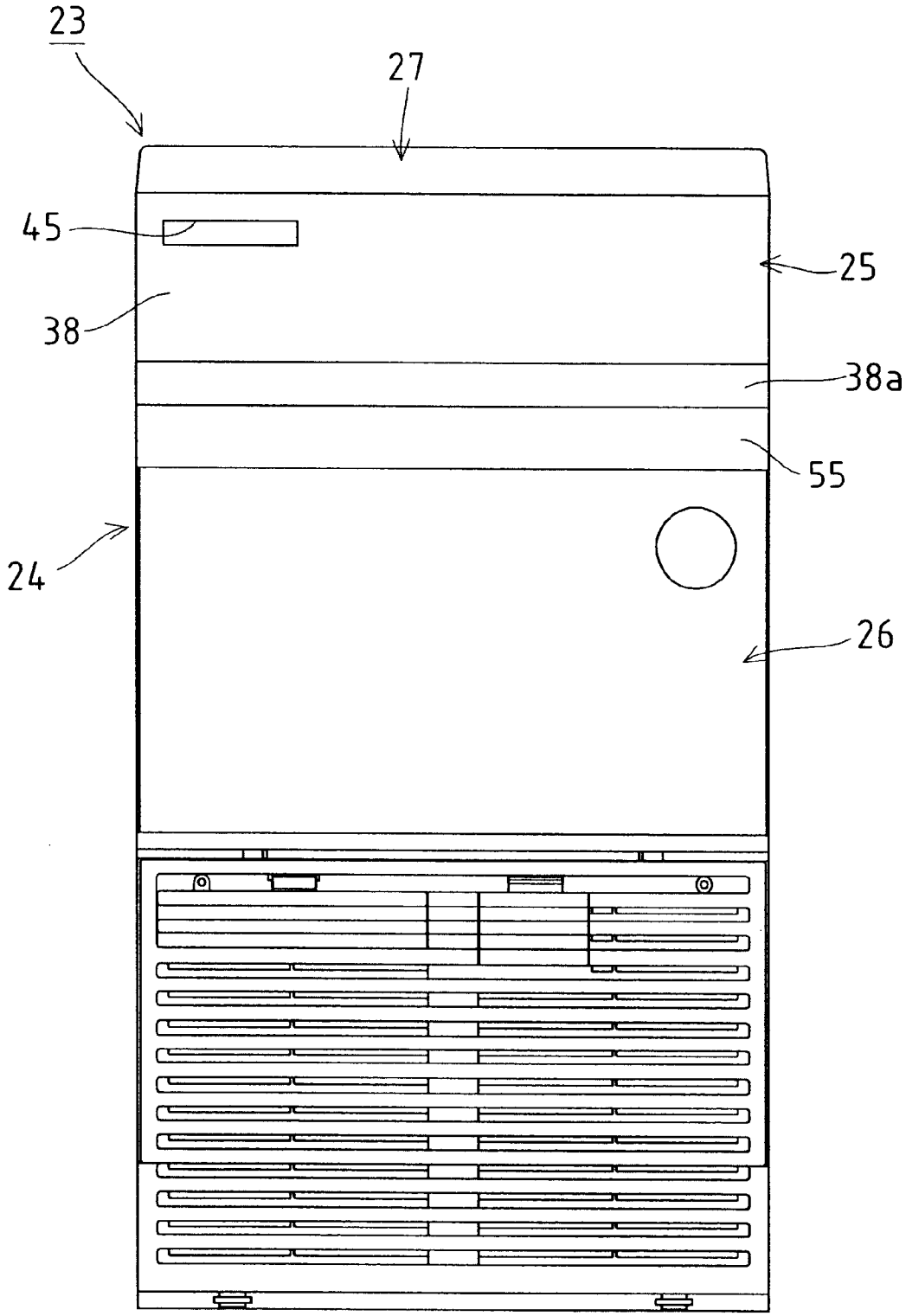
FIG. 2 is a front view of an automatic ice-making machine in which the thermal insulation box of the embodiment is employed.
Figure 3:
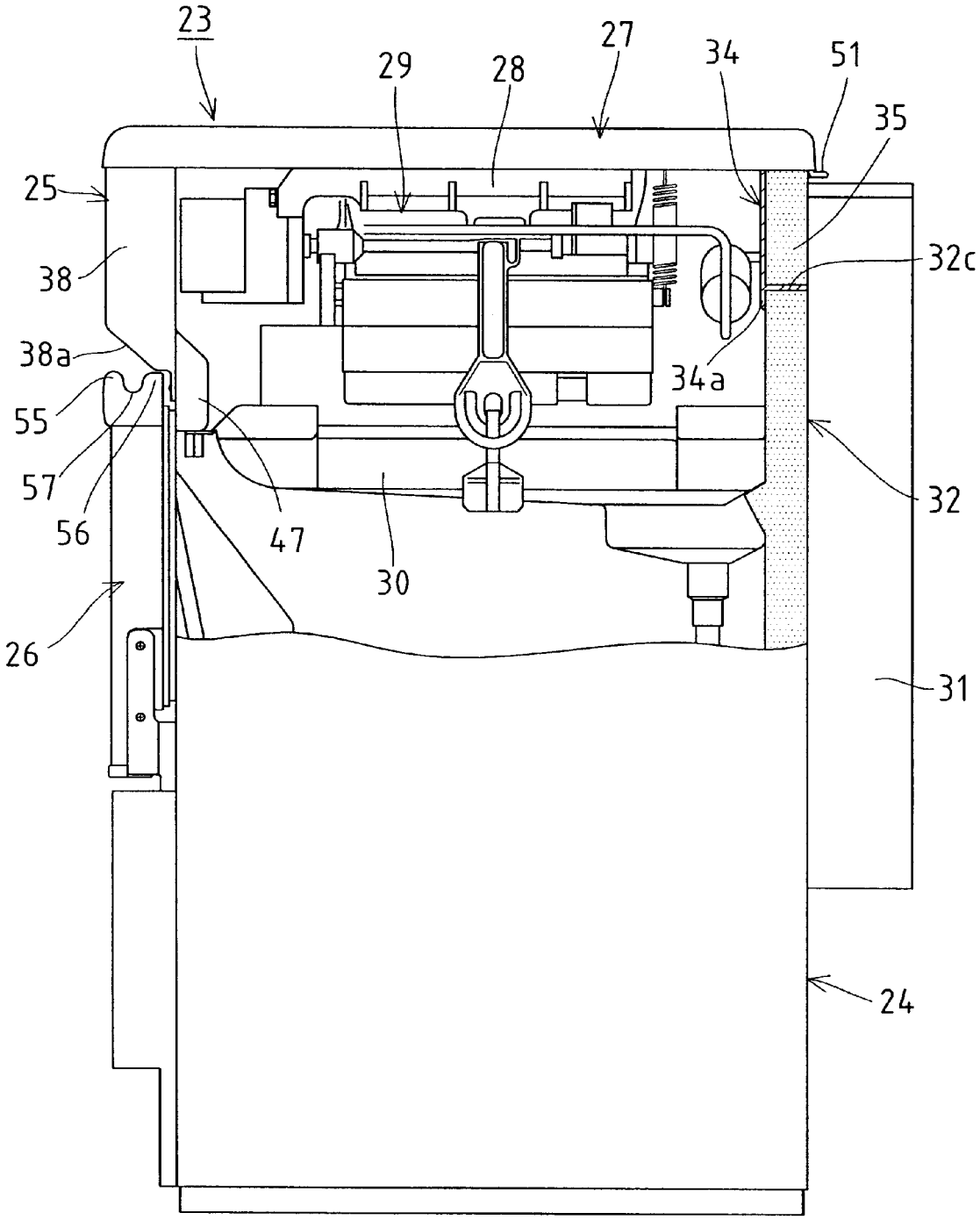
FIG. 3 is a partly cutaway side view of the automatic ice-making machine according to the embodiment.

As shown in FIGS. 1 to 3, a thermal insulation box 23 of the embodiment is composed essentially of a casing body 24 opening forward and upward; a front panel 25 removably attached to an upper front part of the casing body 24; a door 26 attached openably to the front of the casing body at a position lower than the front panel 25; and a top plate 27 removably provided on the top of the casing body 24. Incidentally, an ice-making unit 29 suspended from a mounting frame 28 provided horizontally in an upper part of the casing body 24 is located in an upper space in the casing body, and a drain tray 30 is adapted to locate below the ice-making unit 29. Meanwhile, a rear cover 31 for covering outside lines, refrigerant piping, etc. (to be described later) is attached to the rear face of the casing body 24.

Casing Body

Figure 4:
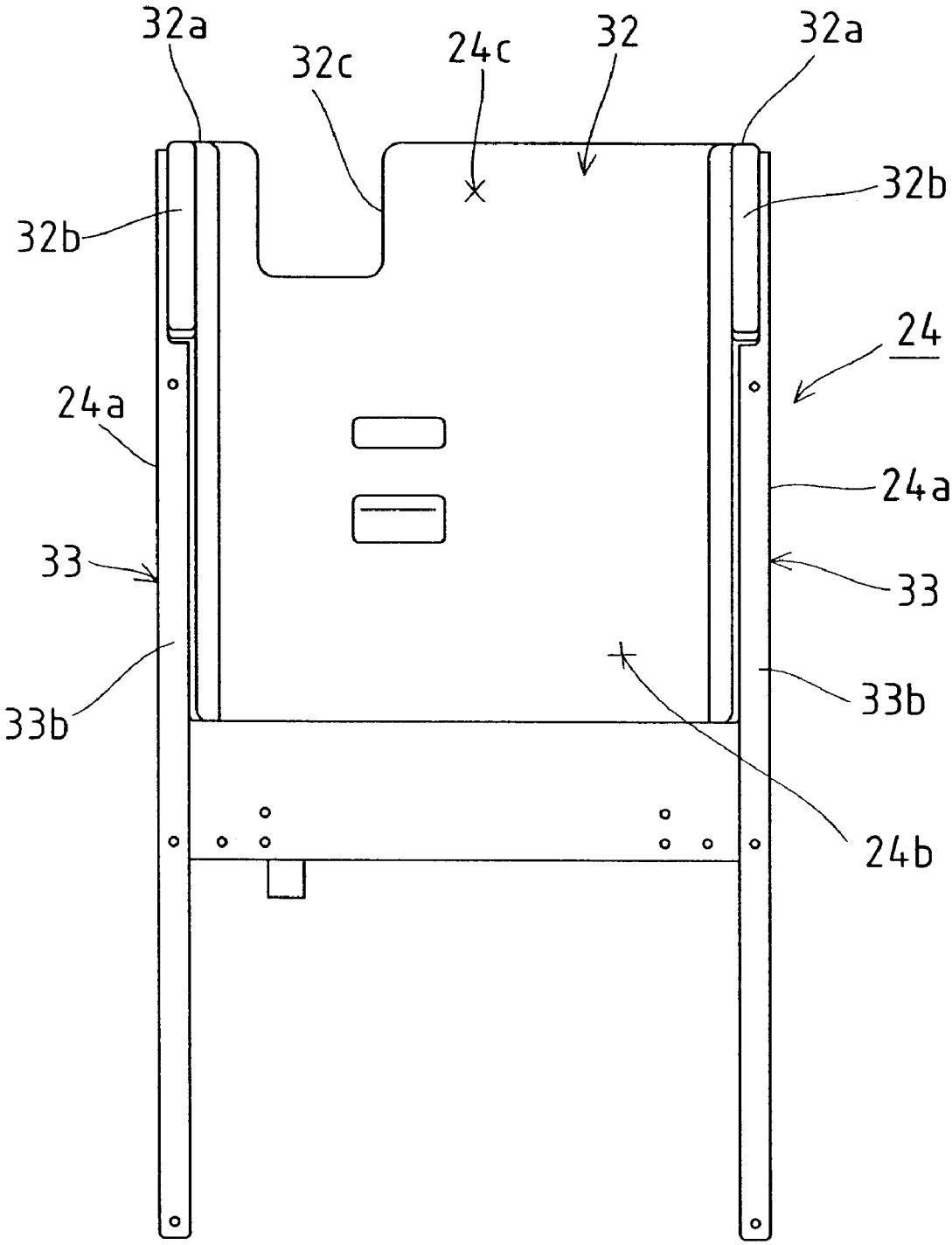
FIG. 4 is a front view of the main body of the thermal insulation box according to the embodiment.
Figure 5:
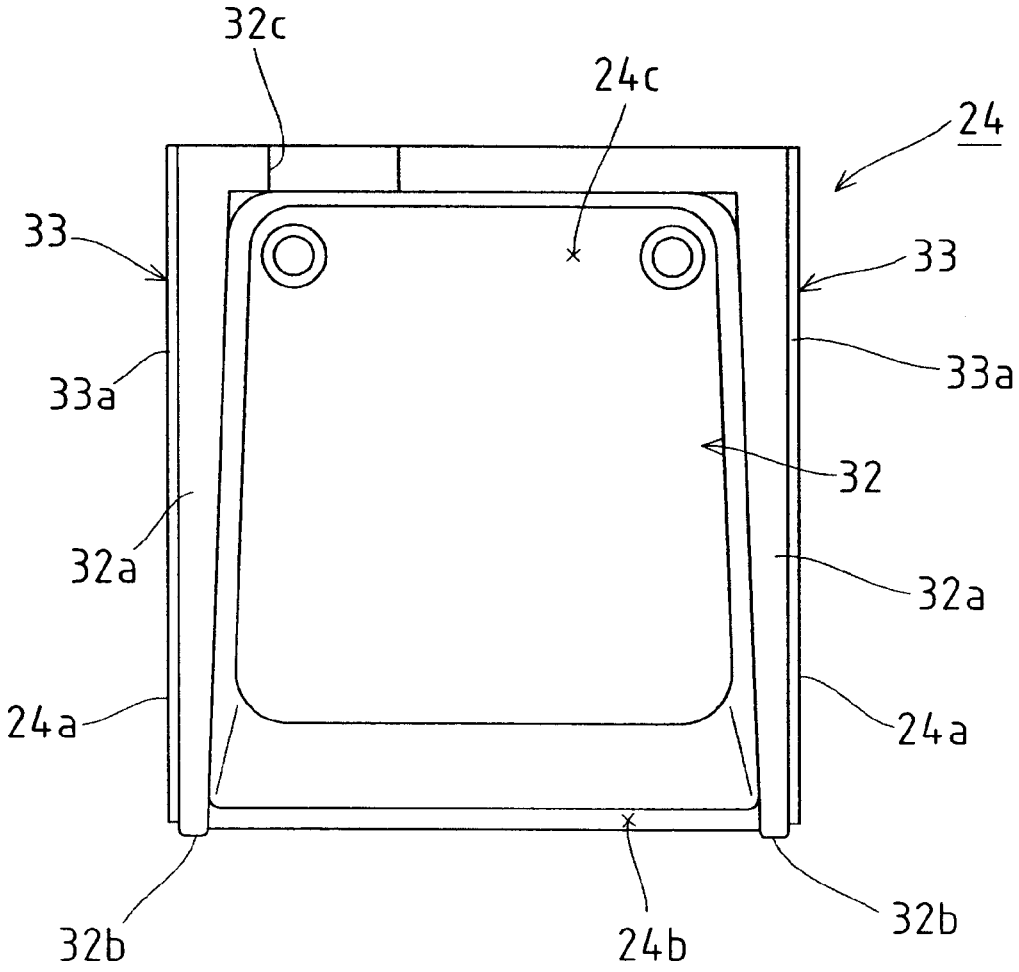
FIG. 5 is a plan view of the main body of the thermal insulation box according to the embodiment.
Figure 6:
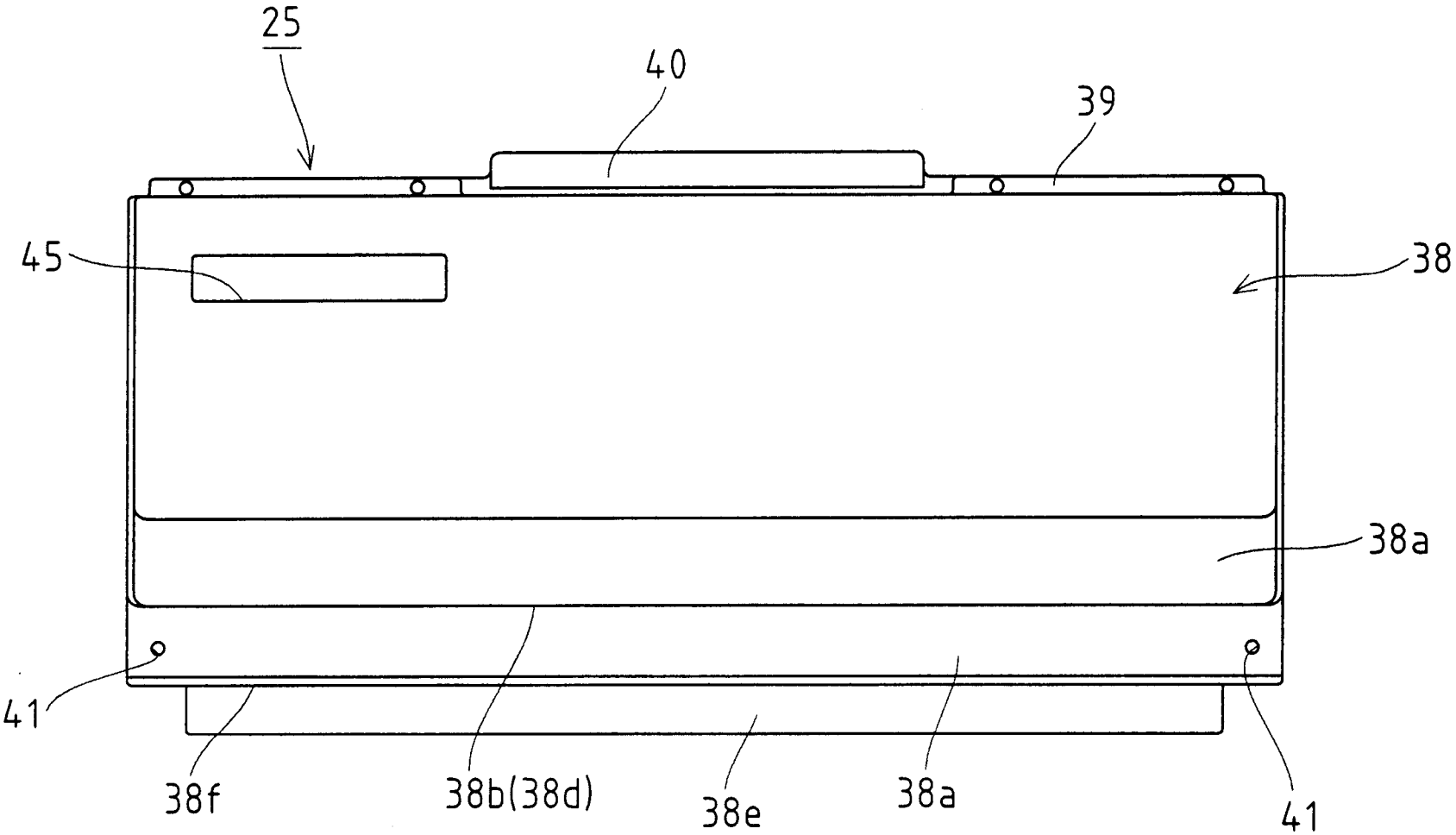
FIG. 6 is a front view of the front panel according to the embodiment.
Figure 14:
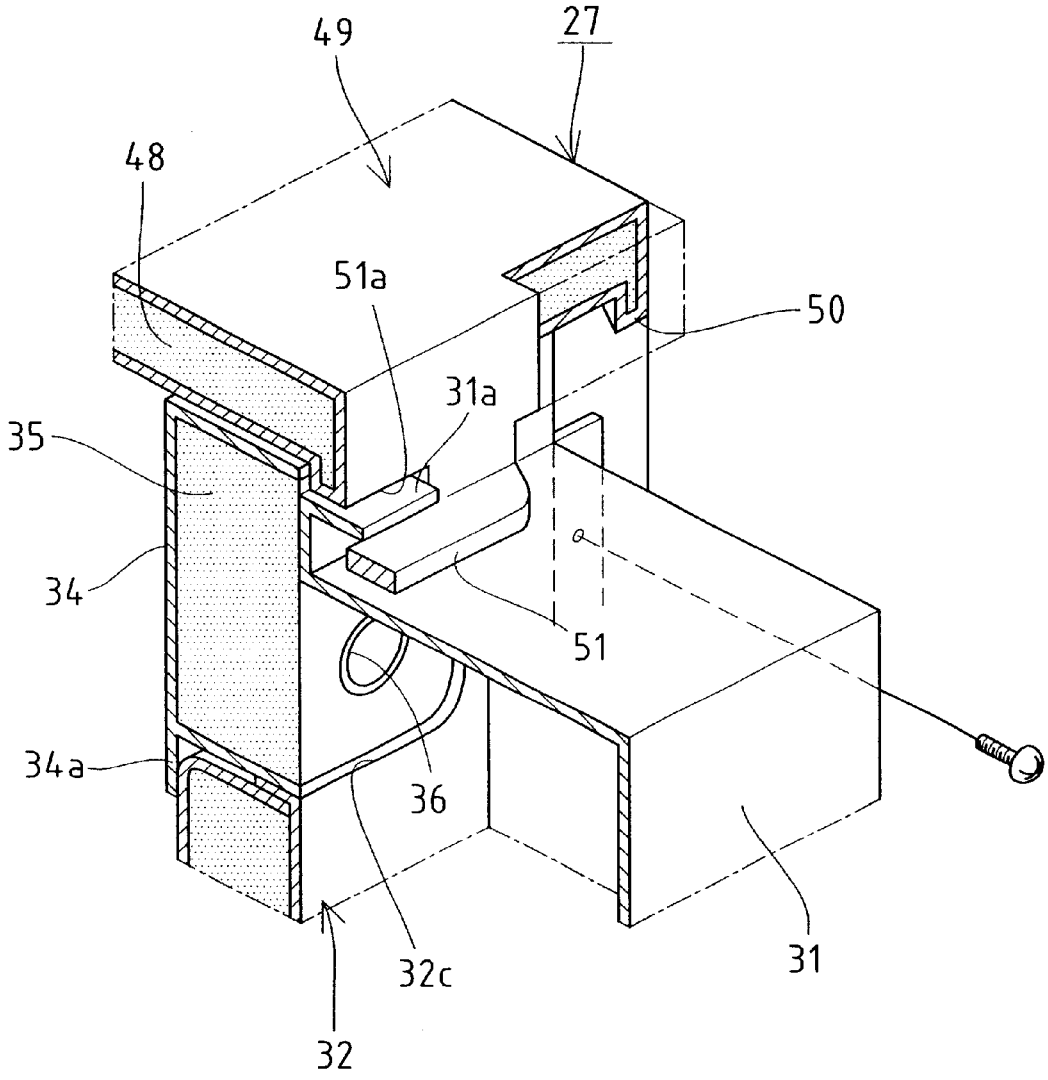
FIG. 14 is a partly cutaway schematic perspective view of the fitting portions of the casing body, the top plate and of a rear cover according to the embodiment.
Figure 15:
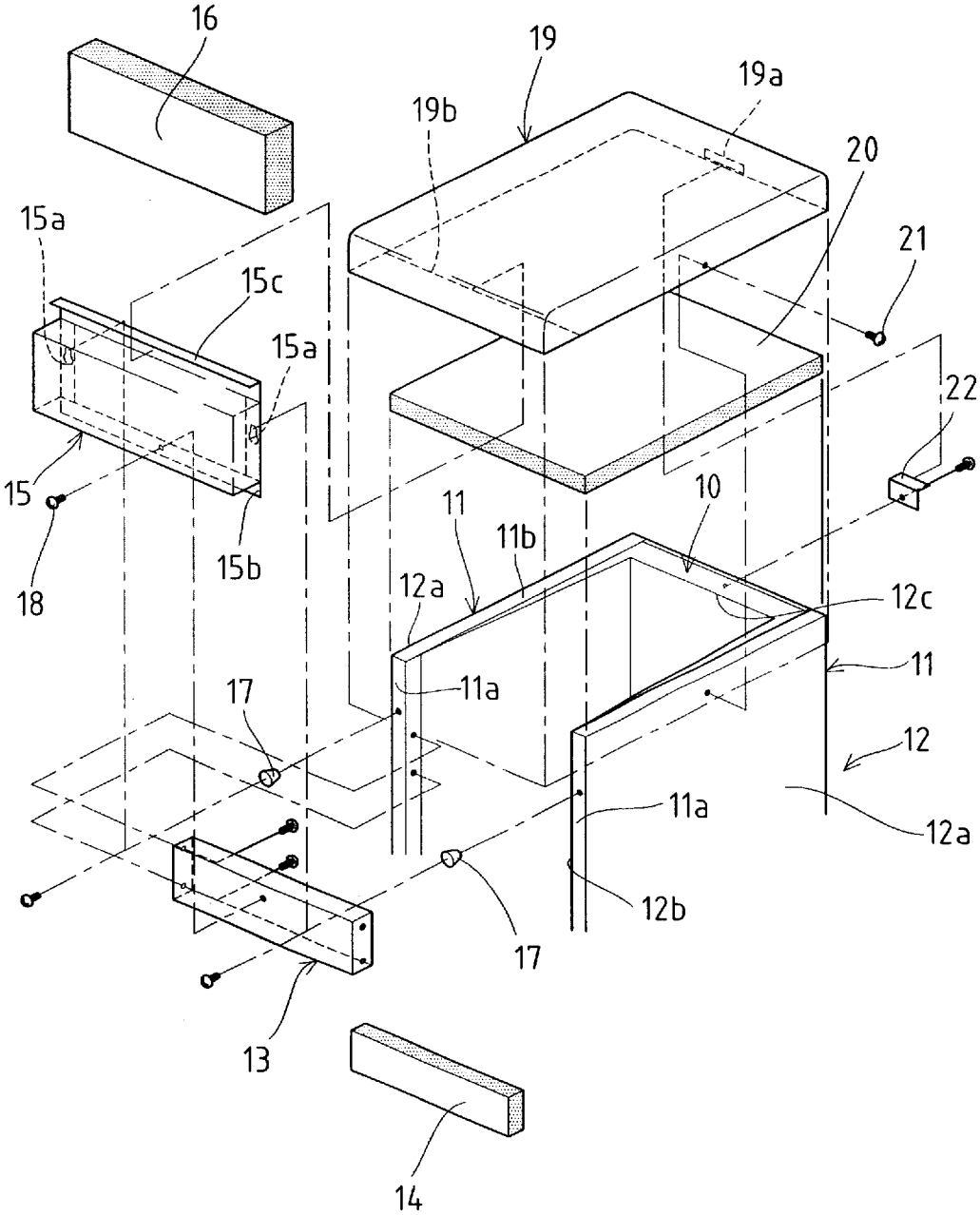
FIG.15 PRIOR ART
FIG. 15 is an exploded schematic perspective view of relevant portions of a thermal insulation box according to the prior art.

The casing body 24 is formed by disposing a pair of side panels 33 respectively on the external sides of a right side wall and a left side wall of an ice bin 32 having a heat insulation structure, which are spaced away from each other crosswise. The ice bin 32 opens forward and upward. The casing body 24 has a forward opening 24*b* and an upward opening 24*c* defined between a pair of sidewalls 24*a* each containing the side wall of the ice bin 32 and the side panel 33. The ice bin 32 has upper protrusions 32*a* each protruding upward from the top face leaving thereon a zone of a predetermined width inward (toward the ice bin) from the outer edge, and each sidewall has a front protrusion 32*b* protruding forward from the front end face thereof over a predetermined length from the upper end. The front protrusion 32*b* is formed continuously from the upper protrusion 32*a*. Further, the ice bin 32 has on the rear wall a notch 32*c* opening upward at a position closer to the left sidewall in FIG. 4. Outside lines, refrigerant piping, etc. led out from the ice-making unit 29 are designed to be drawn out through the notch 32*c*. A covering body 34, which is made of a resilient material such as rubber and synthetic resin and which is box-shaped and opens backward, is fitted into the notch 32*c*, as shown in FIG. 14. Further, the covering body 34 has a heat-insulating material 35 inserted thereto so that it can secure heat-insulating property. The covering body 34 and the heat-insulating material 35 contain a through hole 36 defined thicknesswise through them continuously, and the outside lines, refrigerant piping, etc. are drawn through the through hole 36 to the outside. Meanwhile, a flange 34*a* is formed integrally with the covering body 34 along the inner right and left edges, as well as, the inner lower edge which are to be located on the ice bin side. The flange 34*a* is abutted against the inner surface of the ice bin 32 so as to prevent slipping off of the covering body 34 and to seal gaps to be formed between the notch 32*c* and the covering body 34.

Figure 13:
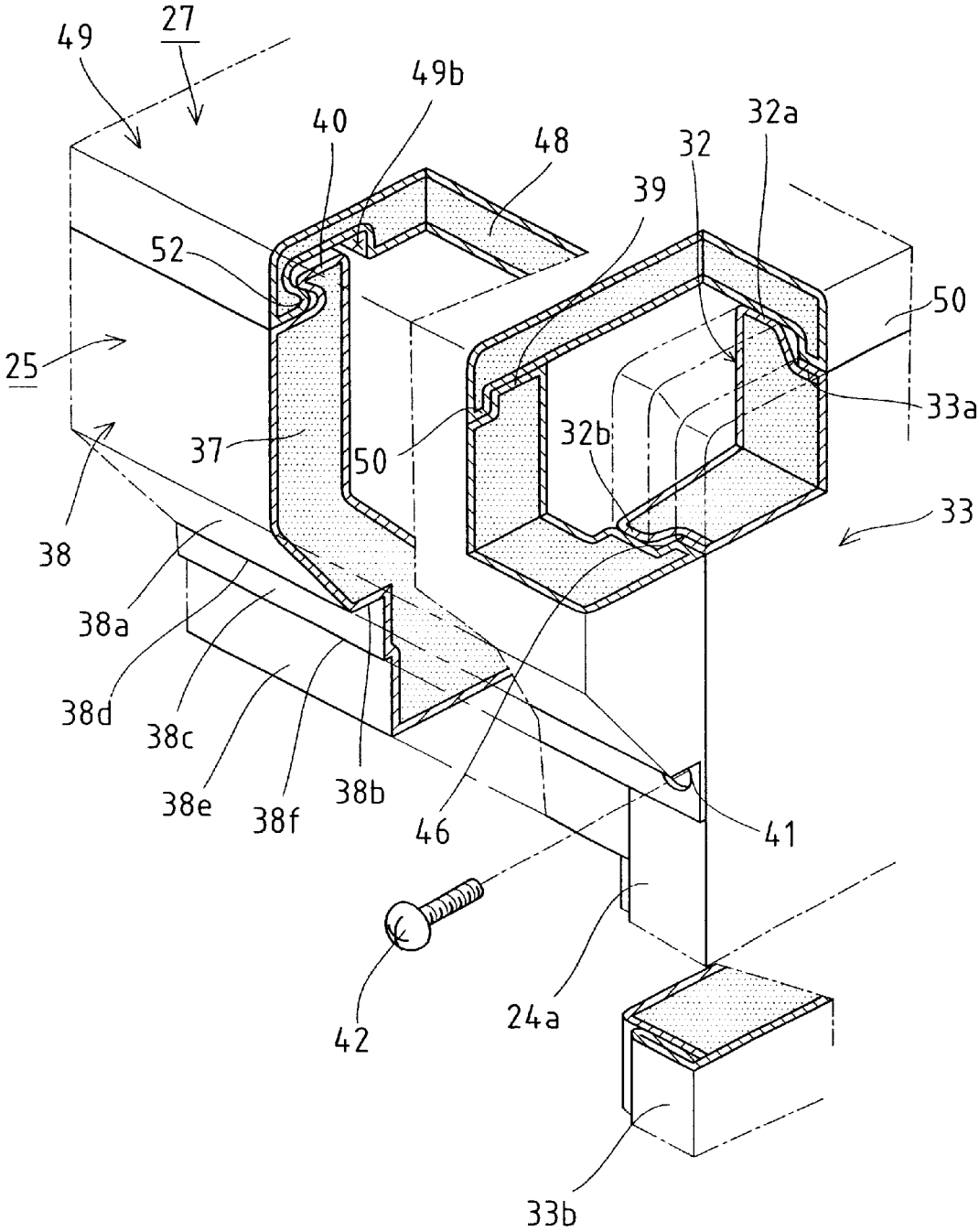
FIG. 13 is a partly cutaway schematic perspective view showing fitting portions of the casing body, the front panel and of the top plate according to the embodiment.

Each side panel 33 described above is formed by bending four sides of a thin plate material inward at right angles. The side panel 33 is positioned by placing the upper bent portion 33*a* thereof on the portion of the top face of the sidewall having no upper protrusion 32*a* formed thereon and by abutting the free end of the upper bent portion 33*a* against the upper protrusion 32*a*. Meanwhile, the front bent portion 33*b* of the side panel 33 is designed to have a small thickness over the length where it opposes the front protrusion 32*b* of the ice bin 32 so that the side panel 33 is positioned by bringing that portion into contact with the portion of the front face of the sidewall where the front protrusion 32*b* is not formed and by abutting the free end of the front bent portion 33*b* against the front protrusion 32*b*. Here, the part of the front bent portion 33*b* abutted against the front face located lower than the front protrusion 32*b* of the ice bin 32 is designed to have a width slightly smaller than the thickness of the sidewall of the ice bin 32 and is double-folded inward such that the free end may not expose itself in the ice bin 32, as shown in FIG. 13. More specifically, the side panels 33 of the embodiment are designed not to expose the free ends thereof in the ice bin 32, so that rust occurred at such free ends is prevented from falling into the ice bin 32. Incidentally, the double-folded front bent portion 33*b* improves strength of the side panel 33.

Front Panel

The front panel 25 covering a part of the forward opening 24*b* of the casing body 24 is blow-molded by a synthetic resin to define therein a packing space to be packed with a foamed heat-insulating material 37 and has a structure preventing exposure of the foamed heat-insulating material 37 to the outside. The front panel 25 is designed to secure sufficient heat-insulating property and to be maintained always hygienically. As shown in FIGS. 6 to 9, the front panel 25 which is substantially rectangular-shaped has a step 39 on the top face of a panel body 38 thereof. The step 39 serves as a fitting ridge. The step 39 protrudes from the top face over an area recessed by predetermined lengths from the front edge and from the crosswise side edges, and an engaging portion 40 is formed substantially at the crosswise middle of the step 39. The engaging portion 40 is engageable with and disengageable from a counterpart engaging portion 52 (to be described later) formed at the front of the top plate 27 (see FIG. 12). Incidentally, the step 39 is covered with a reinforcing rib 50 (to be described later) of the top plate 27 to prevent contaminated water, oil, dust, insects, etc. from entering the ice bin through a gap between the front panel 25 and the top plate 27.

Figure 7:
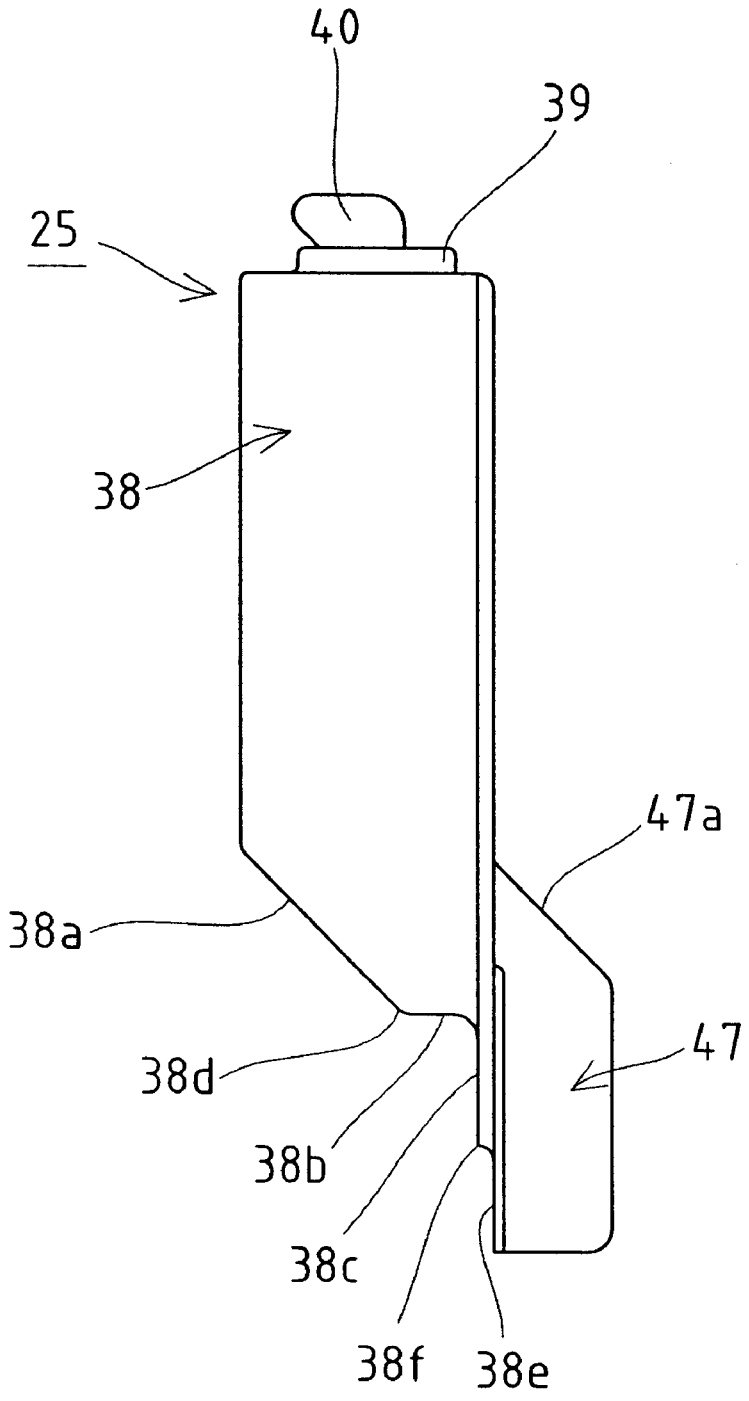
FIG. 7 is a side view of the front panel according to the embodiment.
Figure 12:
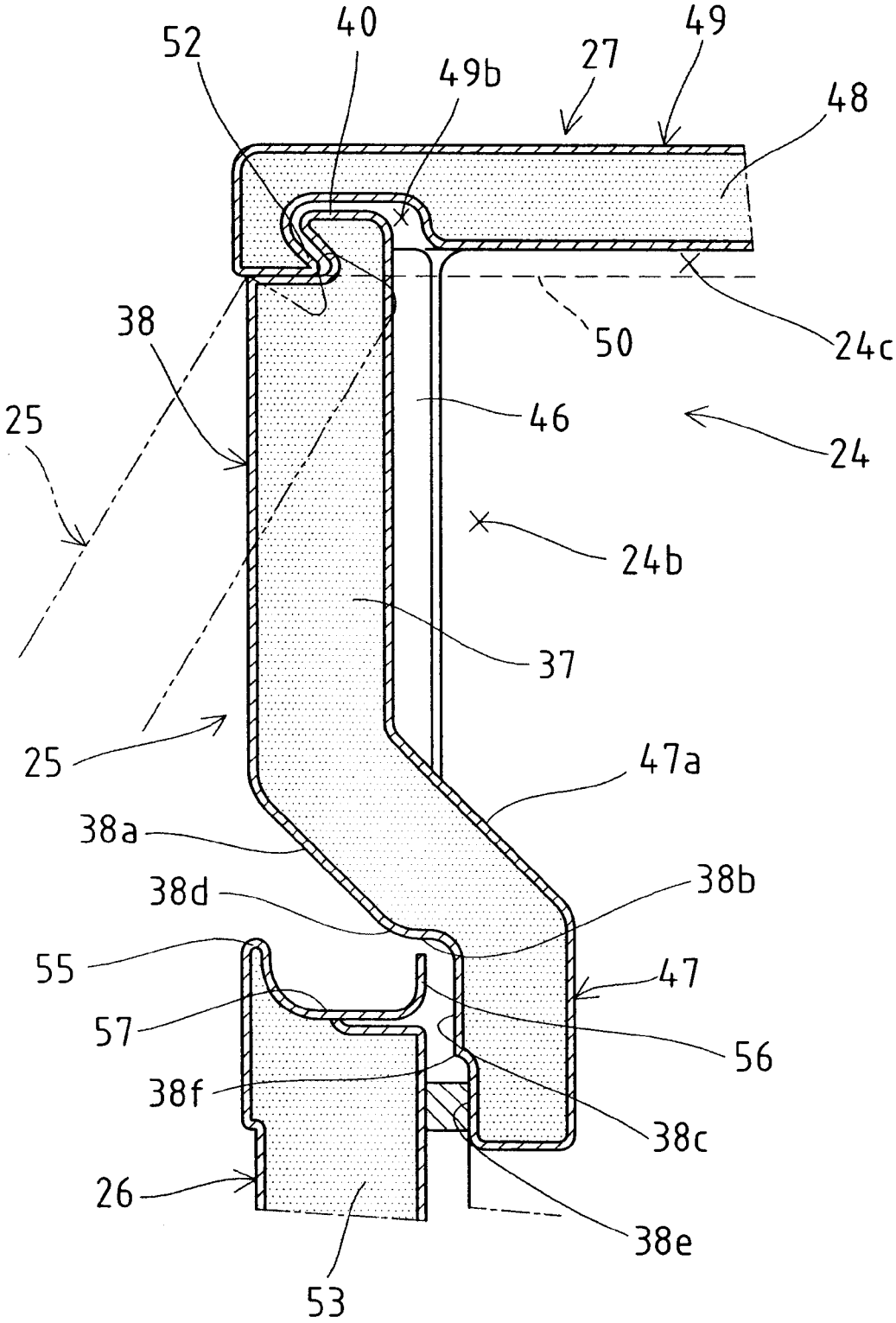
FIG. 12 is a vertical cross-sectional side view of relevant portions of the thermal insulation box according to the embodiment.

As shown in FIG. 7, the panel body 38 has a beveled portion 38*a* formed on the front face at a lower position, which is sloping down backward (toward the ice bin); a horizontal portion 38*b* extended substantially horizontally from the lower end of the beveled portion 38*a;* and a fitting portion 38*c* extended downward from the rear end of the horizontal portion 38*b*. This fitting portion 38*c* contains a pair of through holes 41 defined at a distance in the width direction. The front panel 25 is adapted to be removably attached to the casing body 24 by driving screws 42 (see FIG. 13) inserted from the front side to the through holes 41 into threaded holes 43 defined in the sidewalls 24*a* (front bent portions 33*b* of the side panels 33) of the casing body 24, respectively. Here, in the state where the front panel 25 is attached to the casing body 24, the beveled portion 38*a* locates substantially immediately above the door 26, as shown in FIG. 12, to facilitate catching of a front rib 55 (to be described later), which is formed at the top of the door 26 so as to serve as a handle, with fingers from the front side. In addition, the beveled portion 38*a* contributes to minimizing the gaps between the front panel 25 and the door 26 and improving the appearance design of the casing.

The angled portion connecting the beveled portion 38*a* and the horizontal portion 38*b* to each other functions as an upper draining portion 38*d,* and water droplets deposited on the front face of the panel body 38 and flowing along it are designed to be dropped into a groove 57 (to be described later) of the door 26 through the draining portion 38*d*. Further, when the door 26 is closed, the fitting portion 38*c* is designed to be hidden by the door 26 to be invisible from the front side, preventing the screws from appearing and marring the overall appearance of the casing. An abutting portion 38*e* is extended downward from the lower end of the fitting portion 38*c* so as to form a backward step, and a door packing 54 (to be described later) to be attached to the door 26 is designed to be abutted against the front face of the abutting portion 38*e*. Here, the angled portion connecting the fitting portion 38*c* and the abutting portion 38*e* to each other is designed to function as a lower draining portion 38*f,* and water droplets flowing along the fitting portion 38*c* are adapted to drop onto the door packing 54 and not to flow into the ice bin. Further, in the state where the front panel 25 is attached to the casing body 24, the abutting portion 38*e* locates between the sidewalls 24*a* and functions to prevent inward deformation (dislocation) of them and also to achieve positioning the front panel 25 with respect to the casing body 24.

Figure 8:
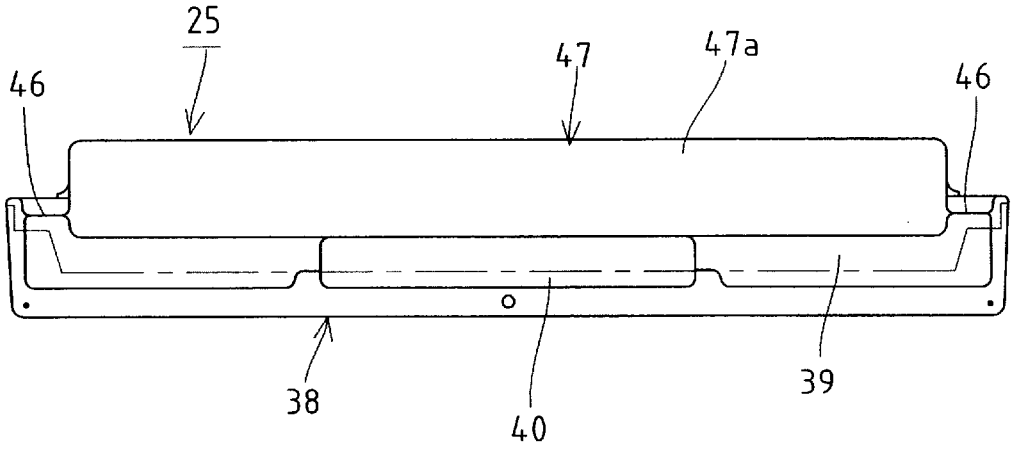
FIG. 8 is a plan view of the front panel according to the embodiment.
Figure 9:
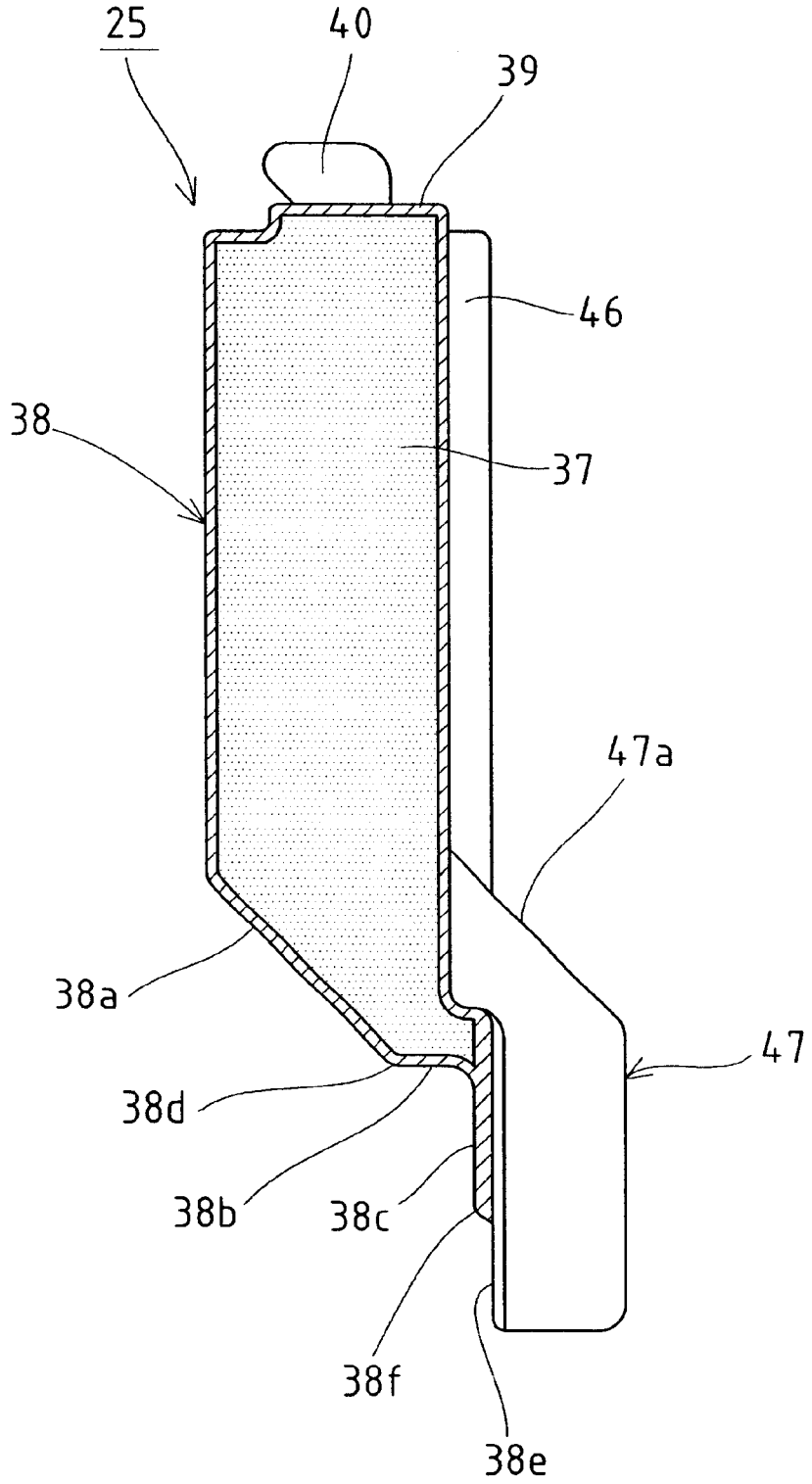
FIG. 9 is a vertical cross-sectional side view of the front panel according to the embodiment.

As shown in FIG. 8, each lateral side face of the panel body 38 is tapered inward from the rear end toward the front end, so that the width of the panel body 38 at the front end face is smaller than the width of the casing body 24 of the thermal insulation box 23. More specifically, for example, even in the case where the thermal insulation box 23 (automatic ice-making machine) is installed such that both lateral side faces thereof are located in intimate contact with wall surfaces or with other kitchen fitments, the front panel 25 defines a clearance between each lateral side face thereof and the wall surface or other kitchen fitments to facilitate detaching from the casing body 24. Here, the rear end face of the panel body 38 is designed to have a width equal to the distance between the outer sides of the sidewalls 24*a,* so that the panel body 38 can cover the forward opening 24*b* defined by the sidewalls 24*a*. Further, the panel body 38 has a depression 45 formed on the front face at a predetermined position, to which a corporate nameplate 44 is bonded. This prevents forward protrusion of the nameplate 44 bonded to the depression 45 and marring the appearance design of the casing.

The panel body 38 has on the rear side a pair of holding recesses (fitting recesses) 46 defined near the crosswise edges thereof. The holding recesses 46 hold the front protrusions 32*b* formed in the ice bin 32, respectively. Fitting of the holding recesses 46 to the front protrusions 32*b* to cover the latter with the former (the fitting structure) is adapted to prevent contaminated water, oil, dust, insects, etc. from entering the ice bin therethrough.

A front frame member 47 is formed integrally with the panel body 38 on the rear face at a lower position. The front frame member 47 is designed to have a width substantially equal to the distance between the sidewalls 24*a* of the casing body 24 (width of the forward opening 24*b*). The front panel 25 is attached to the casing body 24 with the front frame member 47 being located between the sidewalls 24*a* of the casing body 24. In other words, the front frame member 47 functions to prevent inward deformation (dislocation) of the sidewalls 24*a* of the casing body 24 and also to achieve positioning of the front panel 25 with respect to the casing body 24. The drain tray 30 is adapted to be screwed at the front end portion to the lower face of the front frame member 47 (see FIG. 3). Here, a beveled face 47*a* is formed on the top face of the front frame member 47 to slope down backward from the front end to the rear end, as shown in FIG. 7, and droplets flowing along the rear face of the panel body 38 are guided by the beveled face 47*a* into the drain tray 30 to prevent them from adhering to ice blocks and the like stored in the ice bin.

Incidentally, the front panel 25 is embossed on the front face, and each corner thereof is rounded to give improved appearance design and a structure facilitating cleaning. Each portion formed integrally with the panel body 38 is designed to function as a reinforcing rib to minimize warping of the front panel 25 and shrinkage of the resin during blow molding, thus securing necessary strength. Further, locations of inlets for a material for forming the foamed heat-insulating material 37 to be injected into the panel body 38, front frame member 47, etc. and of parting lines are determined considering moldability, foaming properties and workability and also considering such that the inlets and parting lines may not mar the appearance of the casing.

Top Plate

Figure 10:
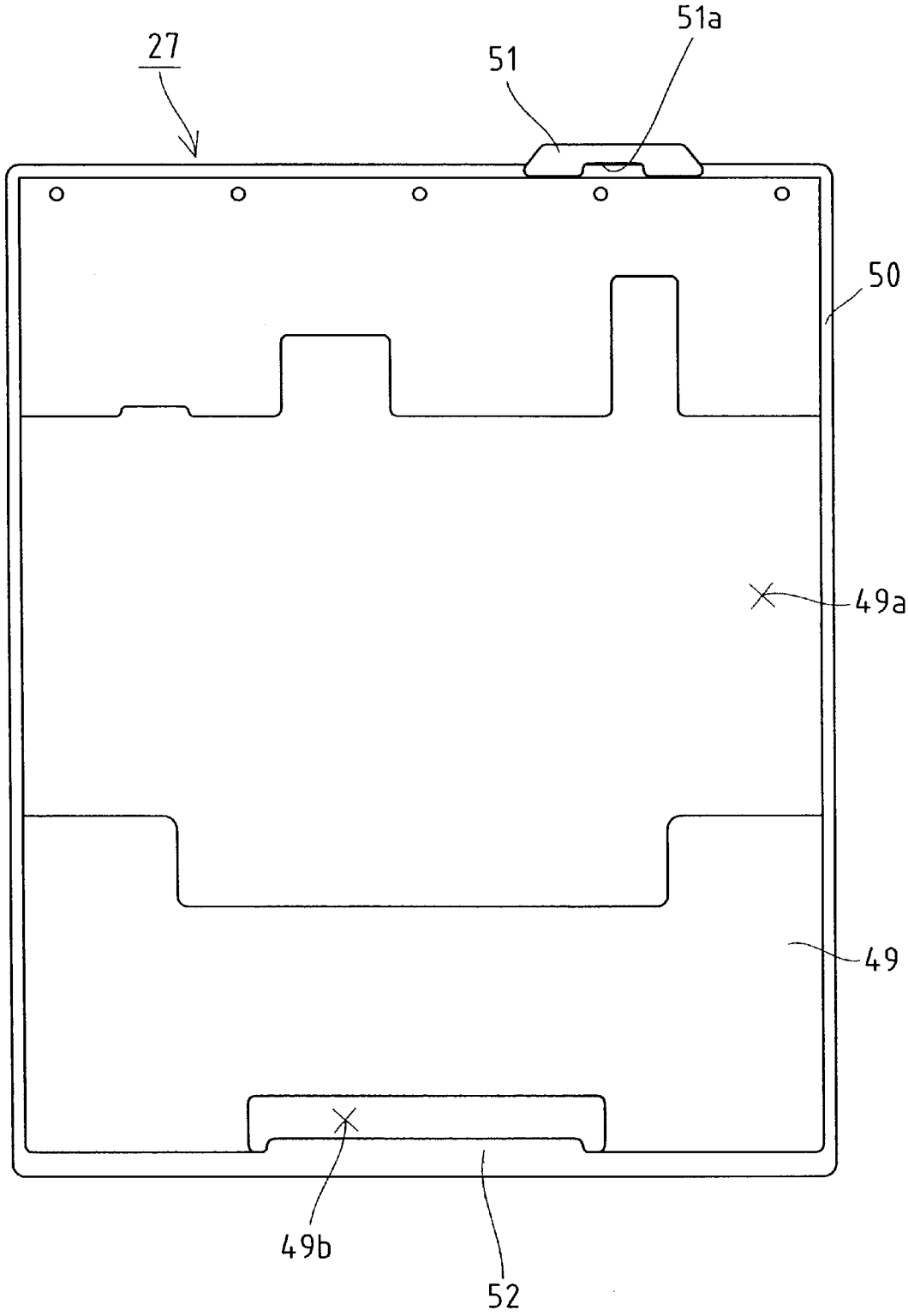
FIG. 10 is a bottom view of a top plate according to the embodiment.
Figure 11:
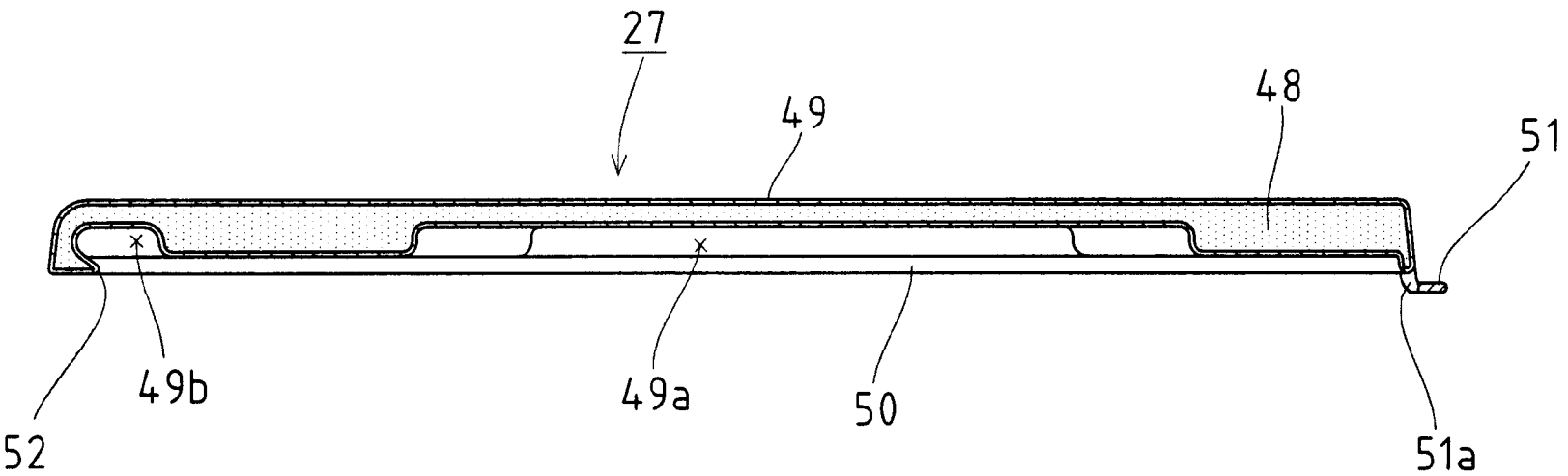
FIG. 11 is a vertical cross-sectional side view of the top plate according to the embodiment.

The top plate 27 covering the upward opening 24*c* of the casing body 24 is blow-molded by a synthetic resin to define therein a packing space to be packed with a foamed heat-insulating material 48 and has a structure preventing exposure of the foamed heat-insulating material 48 to the outside. The top plate 27 is designed to secure sufficient heat-insulating property and to be maintained always hygienically. As shown in FIGS. 10 and 11, a reinforcing rib 50 serving as a fitting portion is formed integrally with a top plate body 49, having a substantially rectangular shape, circumferentially along the lower face (along the lower edge) thereof to secure the necessary strength for the top plate 27 and prevent warping and shrinkage of the resin during blow molding. Here, both lateral side faces of the top plate body 49 are tapered inward from the lower end to the upper end such that the upper end face of the top plate body 49 may have a width smaller than that of the casing body 24 of the thermal insulation box 23 (see FIG. 2). More specifically, even in the case where the thermal insulation box 23 is installed such that both lateral side faces thereof are in intimate contact with the wall surfaces or with other kitchen fitments, the top plate 27 defines a clearance between each lateral side face thereof and the wall surface or other kitchen fitments to facilitate detaching from the casing body 24. The top plate body 49 is embossed on the surface, and each corner thereof is rounded to give improved appearance design and a structure facilitating cleaning.

A fitting piece 51 is formed integrally with the rear reinforcing rib 50 at a predetermined position. The fitting piece 51 contains an engaging hole (catch) 51*a*. The rear cover 31 to be attached to the casing body 24 has a hooking piece (hook) 31*a* formed on the top thereof at a position where it opposes the fitting piece 51. The top plate 27 is designed to be positioned on the rear side by engaging the hooking piece 31*a* with the engaging hole 51*a* of the top plate 27.

As shown in FIGS. 10 and 11, the top plate body 49 has on the lower face an upwardly recessed storage space 49*a* defined substantially at the center so that a part of the ice-making unit 29, outside lines, etc. are housed therein, when the top plate 27 is disposed on the casing body 24. Here, the portion of the lower face having no storage space 49*a* formed thereon is adapted to be located close to the upper face of the mounting frame 28 to intercept flowing of air between the ice bin and the mounting frame. Meanwhile, the top plate body 49 has at the front of the lower face an upwardly recessed front space 49*b* for admitting the engaging portion 40 of the front panel 25, and a counterpart engaging portion 52 disengageably engaged with the engaging portion 40 formed on the front of the space 49*b*. More specifically, the top plate 27 is attached to the casing body 24 by engaging the rear part of the top plate body 49 and the front part thereof with the rear cover 31 and with the front panel 25, respectively. Here, the engaging portion 40 of the front panel 25 is designed to be engageable and disengageable with respect to the counterpart engaging portion 52 of the top plate 27, with the top plate 27 being disposed on the casing body 24 and covering the upward opening 24*c* (see FIG. 12).

In the state where the top plate 27 is attached to the casing body 24, the front part of the reinforcing rib 50 is fitted to cover the step 39 of the front panel 25, and both side parts of the reinforcing rib 50 are fitted to cover the upper protrusion 32*a* of the ice bin 32, as shown in FIG. 13, so that contaminated water, oil, dust, insects, etc. are prevented from entering the ice bin through the gaps between the top plate 27 and the front panel 25 and between the top plate 27 and the casing body 24. Fitting of the top plate 27 to the casing body 24 is achieved by the fitting structure to facilitate positioning of the former to the latter in assembling. Locations of an inlet for a material for forming the foamed heat-insulating material 48 in the top plate body 49 and locations of parting lines are determined considering moldability, foaming properties and workability and also considering such that the inlets and parting lines may not mar the appearance of the casing.

Door

The door 26, which is pivotally attached to the casing body 24 to be able to close the forward opening 24*b* defined lower than the location of the front panel 25, is blow-molded by a synthetic resin to define therein a packing space to be packed with a foamed heat-insulating material 53. The door 26 has on the rear side a door packing 54 for surrounding the forward opening 24*b* of the casing body 24. The upper portion of the packing 54 is designed to be abutted against the front face of the abutting portion 38*e* of the front panel 25 (see FIG. 12). Incidentally, a rubber-like magnet (not shown) is embedded in each side part of the door packing 54 to be abutted against the front face of the associated sidewall 24*a* (the front face of the front bent portion 33*b* of the side panel 33) of the casing body 24. The door 26 is adapted to be retained by the magnet at the closing position of the casing body 24.

The door 26 has at the top a front rib 55 and a rear rib 56 extended over the full width thereof to be spaced depthwise from each other to form a groove 57 between them. The front rib 55 serves as a handle for opening and closing the door 26. Here, the front rib 55 is designed to be high enough to be caught by fingers of an operator and as shown in FIG. 12, to locate below the beveled portion 38*a* of the front panel 25, when the door 26 is at the closing position, facilitating easy operation of the door from the front side. Meanwhile, the rear rib 56 locates under the horizontal portion 38*b* of the front panel 25 so that it may guide water dropping from the upper draining portion 38*d* into the groove 57. Further, the groove 57 opens to the right side and to the left side so that it may be cleaned easily by flushing water, oil, dust, etc. dwelling in the groove 57 through these open ends.

Action of Embodiment

Actions of the thermal insulation box according to the embodiment will now be described. The casing body 24 of the thermal insulation box 23 is composed essentially of a pair of side panels 33 screwed onto the lateral sides of the ice bin 32, respectively. Here, the free end of the upper bent portion 33*a* and the free end at the top of the front bent portion 33*b* in each side panel 33 are abutted against the upper protrusion 32*a* and the front protrusion 32*b* of the ice bin 32, respectively, so that they may not expose themselves in the ice bin. Further, the part of the front bent portion 33*b* present lower than the front protrusion 32*b* is double-folded inward so that the free end thereof may not expose itself in the ice bin. Thus, if rusting should occur at the free ends of the side panels 33 made of a metallic material, rust does not fall into the ice bin, and the ice bin can be maintained always hygienically. The protrusions 32*a*, 32*b* of the ice bin 32 facilitate positioning of the side panels 33.

The front panel 25 is composed essentially of the panel body 38, the front frame member 47, etc. which are blow-molded integrally by a synthetic resin; and the foamed heat-insulating material 37 obtained by foam molding therein. More specifically, since the front panel 25 is entirely made of synthetic resins, there occurs no rusting on the panel surface, whereas the foamed heat-insulating material 37 neither collects dust nor absorbs water, preventing proliferation of bacteria to maintain the front panel 25 hygienically. In addition, each corner in the front panel 25 can be rounded to facilitate maintenance thereof including cleaning, as well as, to improve appearance thereof. Furthermore, since the panel body 38 covering the forward opening 24*b* of the casing body 24 is molded integrally with the front frame member 47 for preventing the sidewalls 24*a* of the casing body 24 from deforming inward, not only the number of parts but also the number of assembling steps can be reduced. Further, the foamed heat-insulating material 37 packed into the front panel 25 improves heat-insulating property thereof and prevents dew formation on the panel surface.

The top plate 27 is blow-molded by a synthetic resin and contains the foamed heat-insulating material 48 obtained by foam molding. In other words, there occurs no rusting on the surface of the top plate, whereas the foamed heat-insulating material 48 neither collects dust nor absorbs water. This prevents proliferation of bacteria and maintains the top plate 27 hygienically. In addition, each corner of the top plate 27 can be rounded to facilitate maintenance thereof including cleaning, as well as, to improve appearance thereof. Furthermore, the foamed heat-insulating material 48 packed into the top plate 27 improves heat-insulating property thereof and prevents dew formation on the surface.

In attaching the front panel and the top plate 27 having the constitutions as described above respectively to the casing body 24, the engaging hole 51*a* formed in the fitting piece 51 of the top plate 27 is engaged with the hooking piece 31*a* of the rear cover 31 screwed onto the rear surface of the casing body 24. In this state, the top plate 27 is placed on the top of the casing body 24. Here, since the lateral sides of the reinforcing rib 50 in the top plate 27 are fitted to cover the upper protrusions 32*a* of the ice bin 32, and since the lower face of the top plate is abutted against the upper faces of the upper protrusions 32*a,* as shown in FIG. 13, gaps are hardly formed there. Even if there should be any gap, this fitting structure can suitably prevent contaminated water, oil, dust, insects, etc. from entering the ice bin. In addition, the reinforcing rib 50 fitted to cover the upper protrusions 32*a* of the ice bin 32 facilitates positioning of the top plate 27 with respect to the casing body 24. Besides, the top plate 27 assumes the state where it is placed on sidewalls 24*a* of the casing body 24, so that when cooking appliances are placed on the top plate 27, the load of the appliances is not applied to the ice-making unit 29 or the like but is supported by the casing body 24.

Incidentally, in installing the ice-making unit 29 before the top plate 27 is attached to the casing body 24, the covering body 34 is fitted in the notch 32*c* defined in the rear wall of the ice bin 32. However, since the heat-insulating material 35 attached to the covering body 34 does not expose itself in the ice bin, contamination of the ice bin can be prevented.

Next, the engaging portion 40 of the front panel 25 is engaged with the counterpart engaging portion 52 of the top plate 27 from the lower front side, and the front frame member 47 is inserted between the sidewalls 24*a* of the casing body 24, as shown in FIG. 12. Further, the fitting portion 38*c* of the panel body 38 is abutted against the front face of each sidewall 24*a* and is screwed as such thereto, achieving fixing of the front panel 25 in position to the casing body 24. Here, the front part of the top plate 27 is also positioned by engaging the engaging portion 40 of the front panel 25 with the counterpart engaging portion 52 of the top plate 27. Thus, the top plate 27 is fixed in position to the casing body 24. Here, the engagement between the engaging portion 40 and the counterpart engaging portion 52 achieves positioning of the front panel 25 in the vertical direction, facilitating assembling of the front panel 25 into the casing body 24.

The front part of the top plate 27 and the upper part of the front panel 25 hardly form gaps therebetween, since the front part of the reinforcing rib 50 in the top plate 27 is fitted to cover the step 39, the lower face of the top plate is abutted against the upper face of the step 39, and the lower face of the reinforcing rib 50 is abutted against the upper face of the panel body 38. Even if there should be any gap, this fitting structure can suitably prevent contaminated water, oil, dust, insects and the like from entering the ice bin. Here, the fitting structure formed by the reinforcing rib 50 of the top plate 27 and the step 39 of the front panel 25 facilitates positioning of the top plate 27, front panel 25 and the casing body 24 in assembling the thermal insulation box. Further, since the holding recesses 46 formed on the rear side of the panel body 38 admit the front protrusions 32*b* formed in the ice bin 32, respectively, the abutting portions of the front panel 25 and those of the casing body 24 form fitting structures between the holding recess 46 and the front protrusion 32*b,* preventing contaminated water, oil, dust, insects, etc. from entering the ice bin.

Then, the door 26 is attached to the casing body 24. In the state where the door 26 is retained at the closing position, the beveled portion 38*a* of the front panel 25 locates above the door 26, as described above, so that the door 26 can be opened and closed easily by catching the front rib 55 of the door 26 with fingers from the front side. Further, water droplets deposited on the front face of the front panel 25 and flowing along it drop through the upper and lower draining portions 38*d* and 38*f* into the groove 57 of the door 26 or onto the door packing 54 to prevent the water droplets from entering the ice bin and contaminating it.

Next, in doing maintenance of the ice-making unit 29 and the like, the door 26 is opened, and the screws 42 fastening the fitting portion 38*c* of the front panel 25 are loosened off. In this state, the engaging portion 40 is disengaged from the counterpart engaging portion 52 of the top plate 27, and thus the forward opening 24*b* of the casing body 24 can be opened. In other words, when the front panel 25 is to be detached from the casing body 24, the top plate 27 need not be removed from the casing body 24, so that the operation can be carried out easily and in a short time. Therefore, even in the case where an automatic ice-making machine is installed under a service counter, maintenance of the machine can be done without drawing it forward from under the counter. Further, since the front frame member 47 for preventing deformation or the like of the sidewalls 24*a* of the casing body 24 is molded integrally with the panel body 38 of the front panel 25, the forward opening 24*b* can be opened substantially fully to facilitate doing maintenance of the ice-making machine.

Meanwhile, since the top plate 27 is positioned on the top of the casing body 24 by engagement with the front panel 25 and with the rear cover 31, the top plate 27 can be detached easily from the casing body 24 merely by removing either the front panel 25 or the rear cover 31 from the casing body 24. Further, since the top plate 27 and the front panel 25 are tapered on each lateral side, they can be easily detached from the casing body 24 even if the thermal insulation box 23 is installed such that both lateral side faces thereof are located in intimate contact with wall surfaces or with other kitchen fitments. Referring to bonding of a corporate name-plate 44 to the front panel 25, the depression formed on the front panel 25 can achieve accurate positioning of the plate 44 and also improves the overall appearance of the front panel.

While the thermal insulation box was employed in an automatic ice-making machine in the embodiment described above, the invention of the present application is not to be limited to it, but it can also be employed as a thermal insulation box for a refrigerator or a freezer. The engagement structure between the front panel and the top plate is not to be limited to that of the embodiment, but various modes can be employed. For example, the top plate may have a protrusion (counterpart engaging portion) protruding backward, which may be engaged with a through hole (engaging portion) defined in the front panel. Further, referring to the hook-and-catch structure between the top plate and the rear cover, the rear cover may have an engaging hole serving as a catch, whereas the top plate may have a hooking piece serving as a hook.

What is claimed is:

1. A thermal insulation box provided with:

a front panel attached to a front part of a casing body having a forward opening so as to cover the forward opening, the front panel being packed with a foamed heat-insulating material; and a top plate disposed on top of the casing body having an upward opening so as to cover the upward opening, the top plate being packed with a foamed heat-insulating material;

said thermal insulation box comprising:

front protrusions formed on front faces of a pair of side panels which are spaced away from each other crosswise of said casing body, said front protrusions protruding forward over a predetermined length from upper ends of said side panels;

fitting recesses formed on rear sides of the front panel and on inner sides from the side edges which are spaced away crosswise, said fitting recesses being fitted so as to cover said front protrusions;

a fitting ridge formed so as to protrude upward stepwise from the top face over an area recessed by predetermined lengths from the front edge and from crosswise side edges of said front panel;

upper protrusions protruding upward from the top face of the side panels of said casing body leaving thereon a zone of a predetermined width inward from the outer edge; and a fitting portion formed circumferentially along the lower face of the top plate, side edge portions thereof being fitted so as to cover said upper protrusions of said side panels, and a front portion thereof being fitted so as to cover said fitting ridge of said front panel.

* * * * *